US011857129B1

(12) United States Patent
Ebrahimi Afrouzi et al.

(10) Patent No.: US 11,857,129 B1
(45) Date of Patent: Jan. 2, 2024

(54) ROBOTIC FLOOR CLEANING DEVICE WITH CONTROLLED LIQUID RELEASE MECHANISM

(71) Applicants: Ali Ebrahimi Afrouzi, San Jose, CA (US); Azadeh Afshar Bakooshli, San Jose, CA (US); Masih Ebrahimi Afrouzi, Berkeley, CA (US); Nema Lankarani, Berkeley, CA (US); Masoud Nasiri Sarvi, Toronto (CA)

(72) Inventors: Ali Ebrahimi Afrouzi, San Jose, CA (US); Azadeh Afshar Bakooshli, San Jose, CA (US); Masih Ebrahimi Afrouzi, Berkeley, CA (US); Nema Lankarani, Berkeley, CA (US); Masoud Nasiri Sarvi, Toronto (CA)

(73) Assignee: AI Incorporated, Toronto (CA)

( * ) Notice: Subject to any disclaimer, the term of this patent is extended or adjusted under 35 U.S.C. 154(b) by 843 days.

(21) Appl. No.: 15/673,176

(22) Filed: Aug. 9, 2017

Related U.S. Application Data

(60) Provisional application No. 62/372,932, filed on Aug. 10, 2016.

(51) Int. Cl.

| | |
|---|---|
| ***A47L 11/12*** | (2006.01) |
| ***A47L 11/40*** | (2006.01) |
| *A47L 11/28* | (2006.01) |

(52) U.S. Cl.
CPC ..... *A47L 11/125* (2013.01); *A47L 11/4011* (2013.01); *A47L 11/4036* (2013.01); *A47L 11/4066* (2013.01); *A47L 11/4083* (2013.01); *A47L 11/28* (2013.01); *A47L 2201/04* (2013.01)

(58) Field of Classification Search
CPC ..... A47L 3/22; A47L 13/26; A47L 11/408; A47L 11/4088; A47L 2201/026; A47L 11/03; A47L 11/1625; A47L 11/185; A47L 11/28; A47L 11/282; A47L 11/283;
(Continued)

(56) References Cited

U.S. PATENT DOCUMENTS 17,158 A * 4/1857 Luce ..... B05B 9/06 239/156
3,696,458 A * 10/1972 Leifheit ..... A47L 11/4072 15/50.3

(Continued)

FOREIGN PATENT DOCUMENTS

WO WO-2006046053 A1 4/2006

*Primary Examiner* — Lee D Wilson
*Assistant Examiner* — Alberto Saenz

(57) ABSTRACT

A robotic floor cleaning device that features a controlled liquid releasing mechanism. A rotatable cylinder with at least one aperture for storing a limited quantity of liquid is connected to a non-propelling wheel of the robotic floor cleaning device. There is a passage below the cylinder and between the cylinder and a drainage mechanism. The cylinder is within or adjacent to a liquid reservoir. Each time an aperture is exposed to the liquid within the reservoir it fills with liquid. As the wheel turns the connected cylinder is rotated until the aperture is adjacent to the passage. The liquid in the aperture will flow through the passage and enter the drainage mechanism which disperses the liquid to the working surface. The release of liquid is halted when the connected wheel stops turning.

6 Claims, 4 Drawing Sheets

(58) Field of Classification Search
CPC .. A47L 2201/00; A47L 2201/04; A47L 11/32; A47L 11/325; A47L 13/22; B05B 9/06
USPC ..... 15/320, 50.1, 98; 222/608, 610, 613; 239/155–158
See application file for complete search history.

(56) References Cited

U.S. PATENT DOCUMENTS

| | | | | |
|---|---|---|---|---|
| 7,555,363 | B2 * | 6/2009 | Augenbraun | G05D 1/0225 901/1 |
| 7,578,020 | B2 | 8/2009 | Jaworski et al. | |
| 7,761,954 | B2 | 7/2010 | Ziegler et al. | |
| 7,837,958 | B2 | 11/2010 | Crapser et al. | |
| 2005/0229340 | A1 | 10/2005 | Sawalski et al. | |
| 2006/0190133 | A1 | 8/2006 | Konandreas et al. | |
| 2014/0127975 | A1 | 5/2014 | Roy et al. | |
| 2015/0128996 | A1 | 5/2015 | Dooley et al. | |
| 2016/0128532 | A1 * | 5/2016 | Babenhauserheide | A47L 11/201 15/319 |

* cited by examiner

ROBOTIC FLOOR CLEANING DEVICE WITH CONTROLLED LIQUID RELEASE MECHANISM

CROSS-REFERENCE TO RELATED APPLICATIONS

This application claims the benefit of provisional patent application Ser. No. 62/372,932, filed Aug. 10, 2016 by the present inventor.

FIELD OF INVENTION

The present invention relates to robotic devices that clean surfaces, and more particularly, a controlled liquid releasing mechanism.

BACKGROUND OF INVENTION

The following is a tabulation of some prior art that presently appears relevant:

U.S. patent Documents

| Pat. No. | Kind Code | Issue Date | Patentee |
|---|---|---|---|
| 7,578,020 | B2 | Aug. 25, 2009 | S. C. Johnson & Son, Inc. |
| 2015/0128996 | A1 | May 14, 2015 | iRobot Corporation |
| 7,761,954 | B2 | Jul. 27, 2010 | iRobot Corporation |
| 2006/0190133 | A1 | Aug. 24, 2006 | iRobot Corporation |
| 2014/0127975 | A1 | May 8, 2014 | Deming Systems LLC |
| 7,837,958 | B2 | 23 Nov. 2010 | S. C. Johnson & Son, Inc. |
| 2005/0229340 | A1 | Oct. 20, 2005 | S. C. Johnson & Son, Inc. |

International Patent Documents

| Country Code | Patent Number | Kind Code | Issue Date | Patentee |
|---|---|---|---|---|
| WO | 2006046053 | A1 | Apr. 5, 2006 | Reckitt Benckiser Inc. |

The mopping feature of mobile robotic floor cleaning devices is well known in the art. However issues such as the leakage of mopping liquid when the robot is not in movement have remained. In prior art, the mopping liquid is free to flow without any control. Without a controlled liquid release mechanism the mopping liquid is inefficiently consumed resulting in the accumulation of mopping liquid risking damage to the robotic device and often unwanted leakage of said mopping liquid onto a working surface. In other art, the liquid is controllably dispensed onto the flooring surface through a nozzle or by releasing a valve by controller means. When the mopping feature is utilized via a controller the robotic device requires additional equipment to deliver the dispensing instruction to the nozzle thereby requiring additional maintenance and increasing cost. The present invention addresses these issues by introducing a control mechanism whereby the release of mopping liquid is controlled by the rotation of an outside member such as a non-propelling wheel such that mopping liquid is only released when the robotic device is operational and the wheel is rotating thereby preventing leakage and reducing cost.

SUMMARY OF INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

It is a goal of the present invention to introduce a module for a mobile robotic floor cleaning device to have a controlled liquid releasing mechanism for mopping purposes.

The present invention achieves the above stated goal by introducing a control mechanism which manages the release of liquid for mopping purposes. A rotatable cylinder with at least one aperture for storing a limited quantity of mopping liquid is connected to a non-propelling wheel of the robotic floor cleaning device. The cylinder is connected to the non-propelling wheel directly or via an axle or gear mechanism such that cylinder rotation is controlled by the rotation of the wheel. Specifically, the axle turns the rotatable cylinder when the motion of the robotic surface cleaning device occurs. In some embodiments the axle turns the rotatable cylinder when the rotary motion of one or more non-propelling wheels of the robotic floor cleaning device occurs. The cylinder is within or adjacent to a liquid reservoir tank. There is a passage below the cylinder and between the cylinder and a drainage mechanism. Each time at least one aperture is exposed to the liquid within the reservoir tank, it fills with liquid. As the wheel turns the connected cylinder is rotated until the aperture is adjacent to the passage. Upon exposure to the passage, the liquid will flow out of the aperture by means of gravity, pass through the passage, and enter the drainage mechanism, whereby the liquid is delivered onto the working surface. Any number of apertures may be provided within the cylinder to adjust the liquid flow rate.

It is a goal of the present invention to introduce a module for a robotic floor cleaning device utilizing a controlled liquid releasing mechanism for mopping purposes to not release liquid except for when the mobile robotic cleaning device is in motion.

The present invention achieves the above stated goal by introducing a module that releases liquid by the rotation of one or more wheels of the robotic floor cleaning device. By controlling the release of liquid through the rotation of one or more wheels of the robotic floor cleaning device the release of liquid is stopped when the wheels stop turning. In the preferred embodiment, the release of excess liquid is avoided in cases where for example, the wheels jam or the device stops working.

BRIEF DESCRIPTION OF THE DRAWINGS and non-exhaustive features of the present invention are described and depicted with reference to the following figures, wherein like reference numerals refer to like parts throughout the various figures.

DETAILED DESCRIPTION OF THE INVENTION

Figure 1:
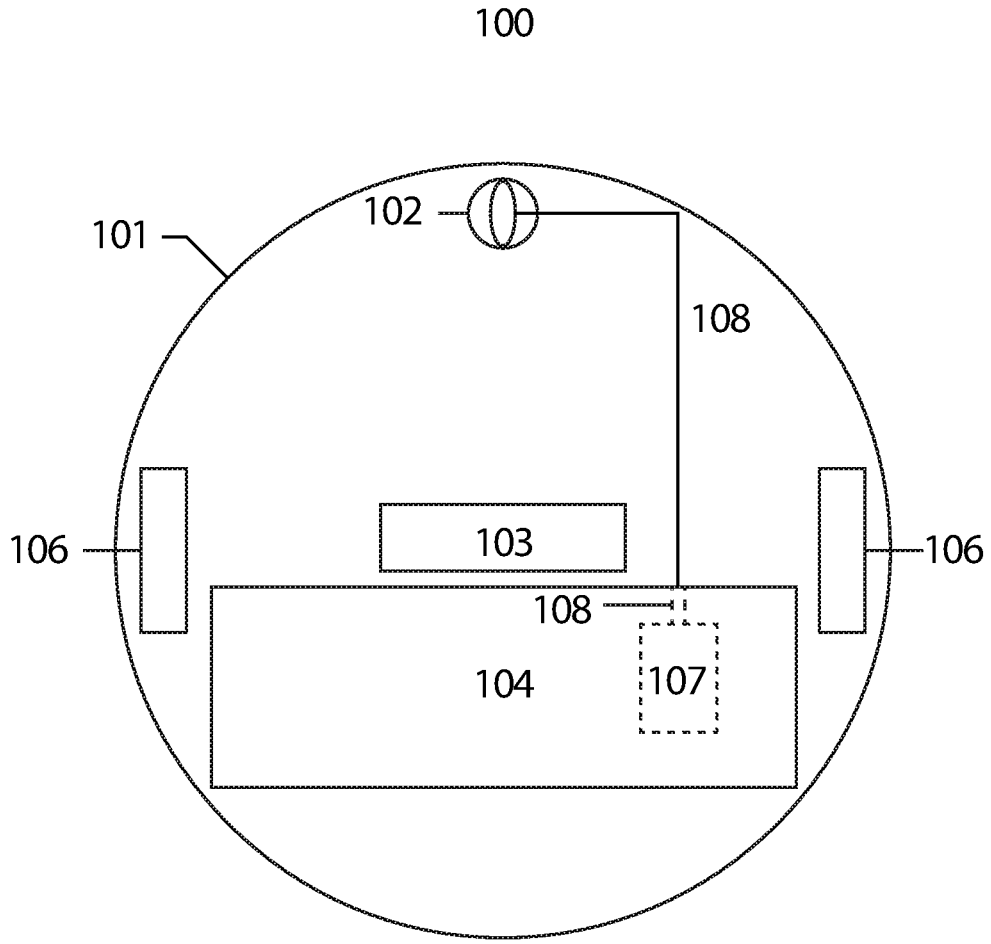
FIG. 1 illustrates a bottom view of a robotic device embodying features of the present invention.

The present invention will now be described in detail with reference to a few embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

As understood herein, the term "robotic floor cleaning device" may be defined generally to include one or more autonomous or semi-autonomous devices having mobility, processing, and/or cleaning elements. For example, a robot or robotic floor cleaning device may comprise a casing or shell, a chassis including a set of non-propelling and/or propelling wheels, a motor to drive the propelling wheels, a cleaning apparatus, a processor and/or controller that processes and/or controls motors and other robotic autonomous or cleaning operations, power management, etc., and one or more clock or synchronizing devices.

Generally, the present invention relates to robotic devices that clean surfaces, and more particularly, a controlled liquid releasing mechanism.

The present invention proposes a robotic floor cleaning device that features a control mechanism for controlling the release of liquid for mopping purposes. Proposed invention secures that the release of liquid by the control mechanism is to be determined by the motion of the robotic surface cleaning device. In some embodiments the release of liquid by the control mechanism is determined by the rotary motion of one or more non-propelling wheels of the robotic floor cleaning device. A rotatable cylinder with at least one aperture for storing a limited quantity of liquid is connected to an outside member such as a non-propelling (non-driving) wheel of the robotic floor cleaning device. The cylinder is connected to the non-propelling wheel directly or via an axle or a gear mechanism such that cylinder rotation is controlled by the rotation of the wheel. More particularly, the axle turns the rotatable cylinder when the motion of the robotic surface cleaning device occurs. In some embodiments the axle turns the rotatable cylinder when the rotary motion of one or more non-propelling wheels of the robotic floor cleaning device occurs. The cylinder is within or adjacent to a liquid reservoir tank. There is a passage below the cylinder and between the cylinder and a drainage mechanism. Each time at least one aperture is exposed to the liquid within the reservoir tank, it fills with liquid. As the wheel turns, the connected cylinder is rotated until the aperture is adjacent to the passage. Upon exposure to the passage, the liquid will flow out of the aperture by means of gravity, pass through the passage, and enter the drainage mechanism, whereby the liquid is delivered onto the working surface.

A "drainage mechanism," as understood herein, may be defined generally to include a mechanism for dispersing liquid throughout a plane. For example, a drainage mechanism may include a hollow body with a perforated underside through which liquid may pass to surfaces below.

As was mentioned above, the release of liquid by the control mechanism is determined by the motion of the robotic surface cleaning device and/or is determined for some embodiments by the rotary motion of one or more non-propelling wheels of the robotic surface cleaning device. In particular, the rotary motion of non-propelling wheels causes the rotary motion of the rotatable cylinder, which causes exposure of the cylinder's aperture filled with liquid to the passage connected to the drainage mechanism. The faster the non-propelling wheels rotates, the faster the cylinder turns, the faster the aperture releases liquid into the passage. Moreover, if the non-propelling wheels rotates, say, twice faster, the cylinder turns twice faster, and the aperture releases liquid into the passage twice faster. Furthermore, when the rotary motion of the non-propelling wheel halts, the cylinder stops turning, and the further release of liquid into the passage is stopped as well. It is worth meanwhile to note that speed of the robotic surface cleaning device is proportional to the rate of the rotary motion of the non-propelling wheels. The above reasoning explains that rapidity of the release of liquid into the passage and the drainage mechanism is proportional to the speed of the robotic surface cleaning device and/or is proportional for some embodiments to the rate of the rotary motion of one or more non-propelling wheels.

Referring to FIG. 1, a bottom view of a robotic floor cleaning device 100 is illustrated. Robotic floor cleaning device 100 is comprised of chassis 101, non-propelling wheel 102, motor 103, mop module 104, and propelling wheels 106. Rotatable cylinder 107 is positioned inside mop module 104 and is connected to non-propelling wheel 102 by connecting outside member 108 that transfers rotational movement to the cylinder 107. This connecting outside member may be comprised of an axle and/or gear mechanism.

Figure 2A:
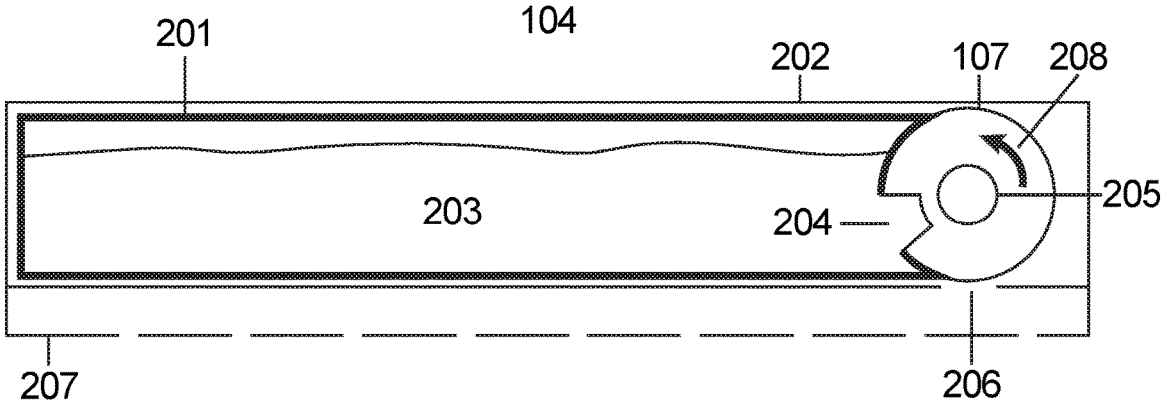
FIG. 2A illustrates a cross-sectional view of mop attachment module embodying features of the present invention whereby rotational cylinder is blocking liquid from escaping the reservoir.

Referring to FIG. 2A, a cross-sectional view of the mop module 104 is illustrated. In this embodiment, the rotatable cylinder 107 is positioned adjacent to the liquid reservoir 201, however, other arrangements are possible. Mop module 104 is comprised of frame 202, liquid reservoir 201 containing liquid 203, a control mechanism comprising a combination of rotatable cylinder 107 with (aperture 204, axle 205), and passage 206, and drainage mechanism 207. In this position, liquid 203 fills aperture 204 and rotatable cylinder 107 is blocking liquid from escaping reservoir 201.

As axle 205 turns, cylinder 107 will be rotated in direction 208 and aperture 204 will be rotated toward passage 206.

Figure 2B:
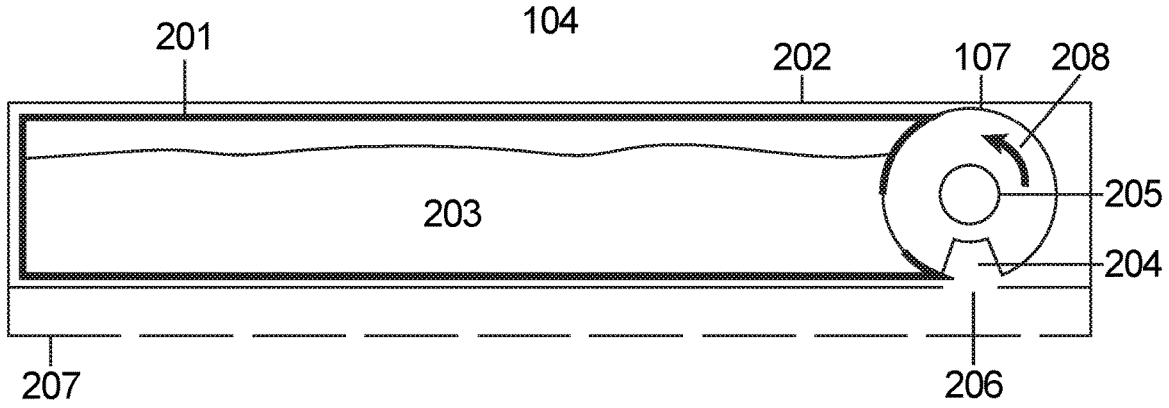
FIG. 2B illustrates a cross-section of a mop attachment module embodying features of the present invention whereby rotational cylinder is positioned adjacent to passage allowing liquid to flow from reservoir.

Referring to FIG. 2B, a cross-sectional view of mop module 104 after cylinder 107 has been rotated in direction 208 is illustrated. In this position, cylinder 107 is rotated so that aperture 204 is adjacent to passage 206. In this position, liquid that had entered aperture 204 while it was previously adjacent to liquid 203 will flow downwards through passage 206 by means of gravity into drainage mechanism 207, to be dispersed onto the working surface.

Liquid 203 is only delivered to drainage mechanism 207 when cylinder 107 is rotating. Since rotation of cylinder 107 is controlled by rotation of axle 205, liquid is no longer delivered to drainage mechanism 207 when axle 205 stops rotating.

The arrangement of components may vary slightly from the example illustrated without departing from the scope of the invention.

Figure 3A:
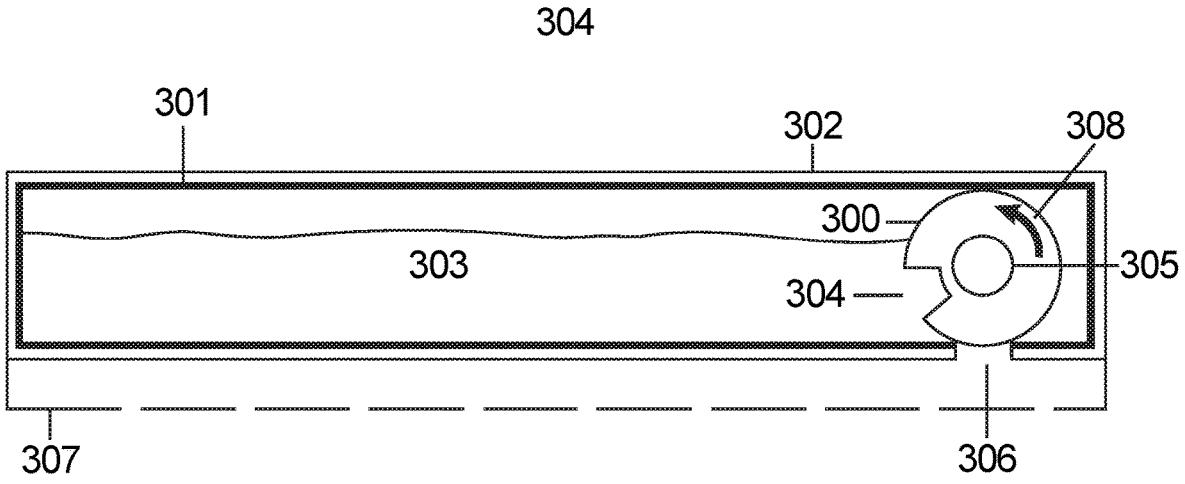
FIG. 3A illustrates a cross-section of a mop attachment module embodying features of the present invention whereby rotational cylinder is blocking liquid from escaping the reservoir.
Figure 3B:
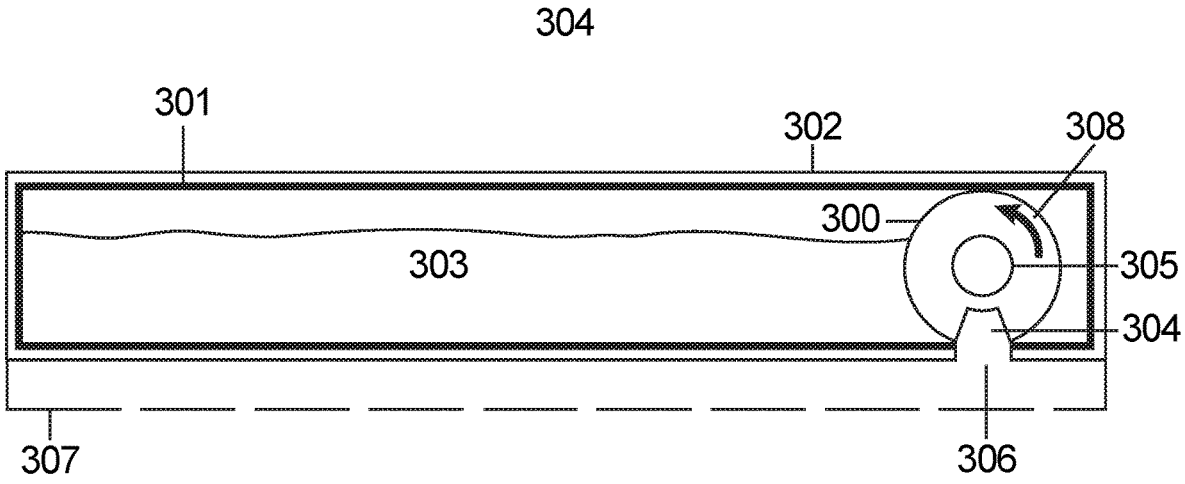
FIG. 3B illustrates a cross-section of a mop attachment module embodying features of the present invention whereby rotational cylinder is positioned adjacent to passage allowing liquid to flow from reservoir.

Referring to FIGS. 3A and 3B, a cross-sectional view of an embodiment of the present invention wherein the rotatable cylinder is provided within the reservoir (rather than adjacent to it) is illustrated. Referring to FIG. 3A, mop module 304 is comprised of frame 302, liquid reservoir 301 containing liquid 303, a control mechanism comprising a combination of rotatable cylinder 300 (with aperture 304, axle 305), and passage 306, and drainage mechanism 307. In this position, liquid 303 fills aperture 304 and rotatable cylinder 300 is blocking liquid from escaping reservoir 301.

As axle 305 turns, cylinder 300 will be rotated in direction 308 and aperture 304 will be rotated toward passage 306.

Referring to FIG. 3B, a cross-sectional view of mop module 304 after cylinder 300 has been rotated in direction 308 is illustrated. In this position, cylinder 307 is rotated so that aperture 304 is adjacent to passage 306. In this position, liquid that had entered aperture 304 while it was previously adjacent to liquid 303 will flow downwards through passage 306 by means of gravity into drainage mechanism 307, to be dispersed onto the working surface.

Liquid 303 is only delivered to drainage mechanism 307 when cylinder 300 is rotating. Since rotation of cylinder 300 is controlled by rotation of axle 305, liquid is no longer delivered to drainage mechanism 307 when axle 305 stops rotating.

Figure 4:
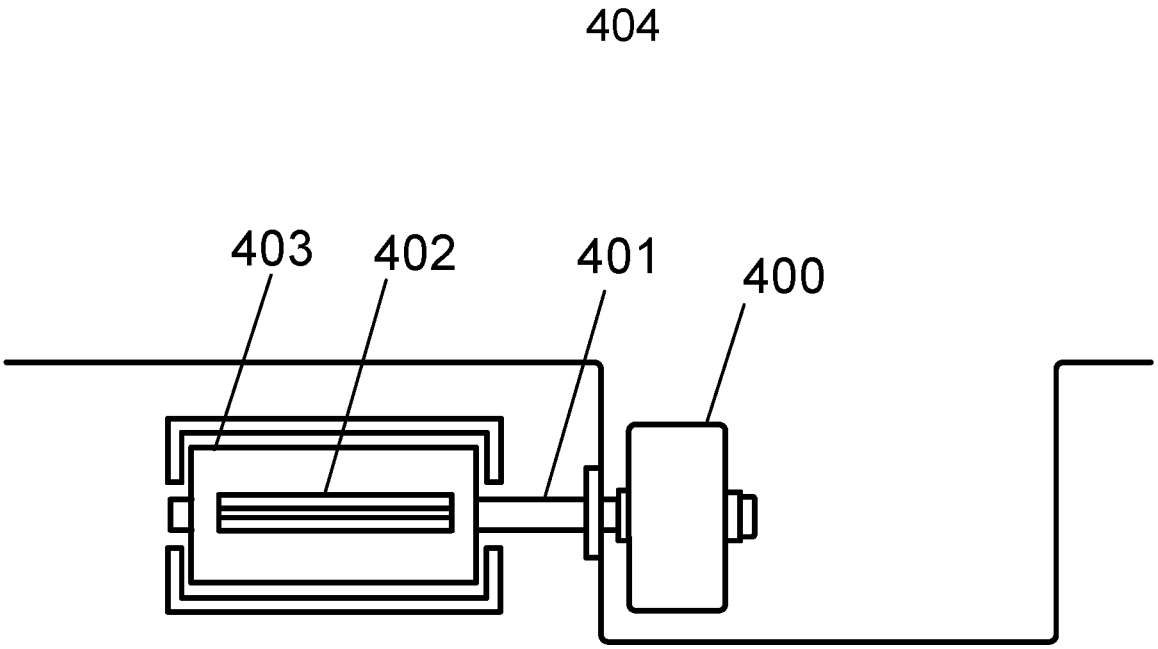
FIG. 4 illustrates a top view of a non-propelling wheel connected to rotatable cylinder.

Referring to FIG. 4, a top view of mop module 404 with non-propelling wheel 400 connected to rotatable cylinder 403 with aperture 402 by member 401 is illustrated. When the robotic floor cleaning device is operational, non-propelling wheel 400 rotates thereby transferring rotational motion to rotatable cylinder 403 by connecting member 401.

It should be understood that in some embodiments, a frame to hold the mop module components may be omitted, and the components thereof may be built directly into the robotic floor cleaning device.

The size, number, and depth of apertures on the rotatable cylinder as well as the rotation speed of the rotatable cylinder may be modified to adjust the liquid flow rate from the reservoir.

In some embodiments, a removable mop module comprising the elements described above may be provided as an attachment to a robotic floor cleaning device. That is, the frame and all components may be removed and replaced as desired by an operator.

In some embodiments the liquid flow rate from said reservoir may be adjusted by adding additional cylinders having at least one aperture and corresponding passages.

We claim:

1. A mop module of a robotic surface cleaning device, the module comprising:
- a frame, further comprising:
  - a liquid reservoir having liquid therein, and
  - a control mechanism for controlling a release of the liquid from said liquid reservoir,
- a drainage mechanism positioned below the frame, wherein:
- the release of the liquid from said liquid reservoir by said control mechanism is controlled by a motion of said robotic surface cleaning device,
- a rapidity of said release of the liquid from said liquid reservoir is proportional to a speed of said robotic surface cleaning device,
- the release of the liquid from said liquid reservoir by said control mechanism is controlled by a rotary motion of one or more non-propelling wheels of said robotic floor cleaning device,
- the release of liquid from said liquid reservoir is solely controlled by the motion of said robotic surface cleaning device,
- said mop module is configured to be positioned within a chassis of said robotic surface cleaning device, and
- at least one component of said mop module is detachable from said chassis.

2. The mop module of claim 1, wherein the control mechanism comprises:
- a rotatable cylinder positioned adjacent to the liquid reservoir and having at least one aperture for holding the liquid,
- an axle turning the rotatable cylinder when the motion of said robotic surface cleaning device occurs, and
- a passage below the rotatable cylinder through which the liquid passes.

3. The mop module of claim 1, wherein the control mechanism comprises:
- a rotatable cylinder positioned adjacent to the liquid reservoir and having at least one aperture for holding the liquid,
- an axle turning the rotatable cylinder when the rotary motion of the one or more non-propelling wheels of said robotic floor cleaning device occurs, and
- a passage below the rotatable cylinder through which the liquid passes.

4. The mop module of claim 3 wherein said rotatable cylinder is connected to the one or more non-propelling wheels via at least one of the axle and a gear mechanism.

5. The mop module of claim 1 wherein the rapidity of said release of the liquid is proportional to a rate of said rotary motion of the one or more non-propelling wheels.

6. The mop module of claim 1 wherein said drainage mechanism disperses the liquid through at least one opening on an underside of said drainage mechanism.

* * * * *